US005841348A

United States Patent [19]

Herzer

[11] Patent Number: 5,841,348

[45] Date of Patent: Nov. 24, 1998

[54] AMORPHOUS MAGNETOSTRICTIVE ALLOY AND AN ELECTRONIC ARTICLE SURVEILLANCE SYSTEM EMPLOYING SAME

[75] Inventor: Giselher Herzer, Bruchkoebel, Germany

[73] Assignee: Vacuumschmelze GmbH, Hanau, Germany

[21] Appl. No.: 890,723

[22] Filed: Jul. 9, 1997

[51] Int. Cl.[6] ..... G08B 13/24

[52] U.S. Cl. ..... 340/551; 29/DIG. 95; 148/103; 148/108; 148/DIG. 3; 420/95

[58] Field of Search ..... 340/551; 148/103, 148/108, 336, 425, DIG. 3; 29/DIG. 95; 420/95

[56] References Cited

U.S. PATENT DOCUMENTS

| | | | |
|---|---|---|---|
| 4,268,325 | 5/1981 | O'Handley et al. | 148/108 |
| 4,484,184 | 11/1984 | Gregor et al. | 340/572 |
| 4,510,489 | 4/1985 | Anderson III et al. | 340/572 |
| 5,252,144 | 10/1993 | Martis | 148/121 |
| 5,469,140 | 11/1995 | Liu et al. | 340/551 |
| 5,568,125 | 10/1996 | Liu | 340/551 |
| 5,628,840 | 5/1997 | Hasegawa | 148/304 |

FOREIGN PATENT DOCUMENTS

| | | |
|---|---|---|
| WO 96/32518 | 10/1996 | WIPO . |
| WO 96/32731 | 10/1996 | WIPO . |

*Primary Examiner*—Glen Swann
*Attorney, Agent, or Firm*—Hill & Simpson

[57] ABSTRACT

A resonator for use in a marker, with a bias element which produces a bias field, in a magnetomechanical electronic article surveillance system is composed of an amorphous magnetostrictive alloy containing iron, cobalt, nickel, silicon and boron in quantities for giving the resonator a quality Q which is between about 100 and 600. The amorphous magnetostrictive alloy is annealed in a transverse magnetic field for giving it a B-H loop which is linear up to about 8 Oe and an anisotropy field strength of at least 10 Oe. When the resonator is excited to resonate by a signal emitted by the transmitter in the surveillance system, it produces a signal at a mechanical resonant frequency which can be detected by the receiver of the detection system. Due to the resonator having a quality Q in the above range, the signal produced by the resonator in a first detector window, beginning approximately 0.4 ms after excitation, has a high amplitude which is no more than 15 dB below its amplitude immediately after excitation, but drops to a level in a the second detection window, beginning approximately 6 mm after excitation, which is at least approximately 15 dB below its level in the first detection window.

54 Claims, 6 Drawing Sheets

FIG. 3
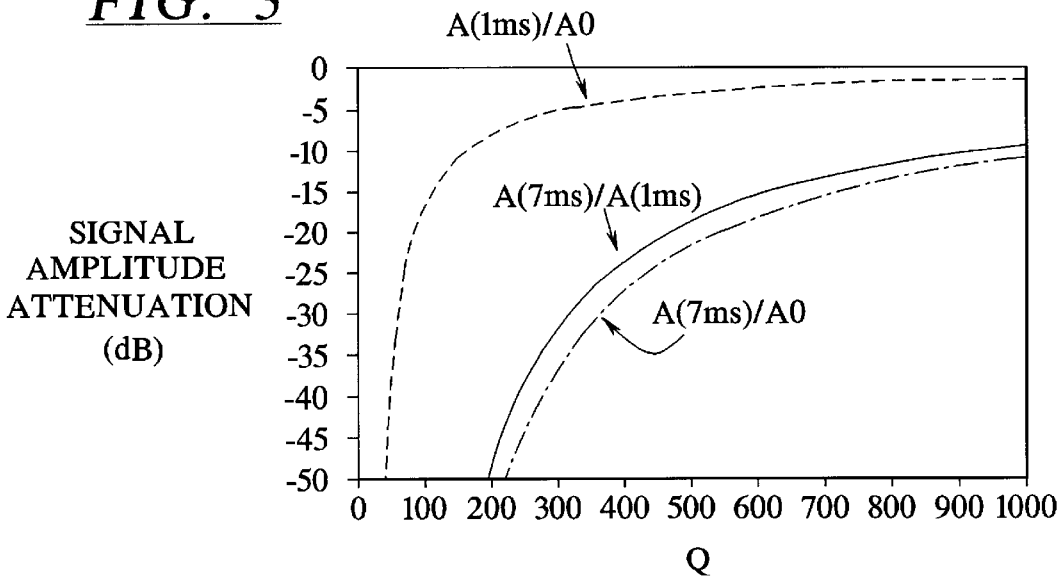
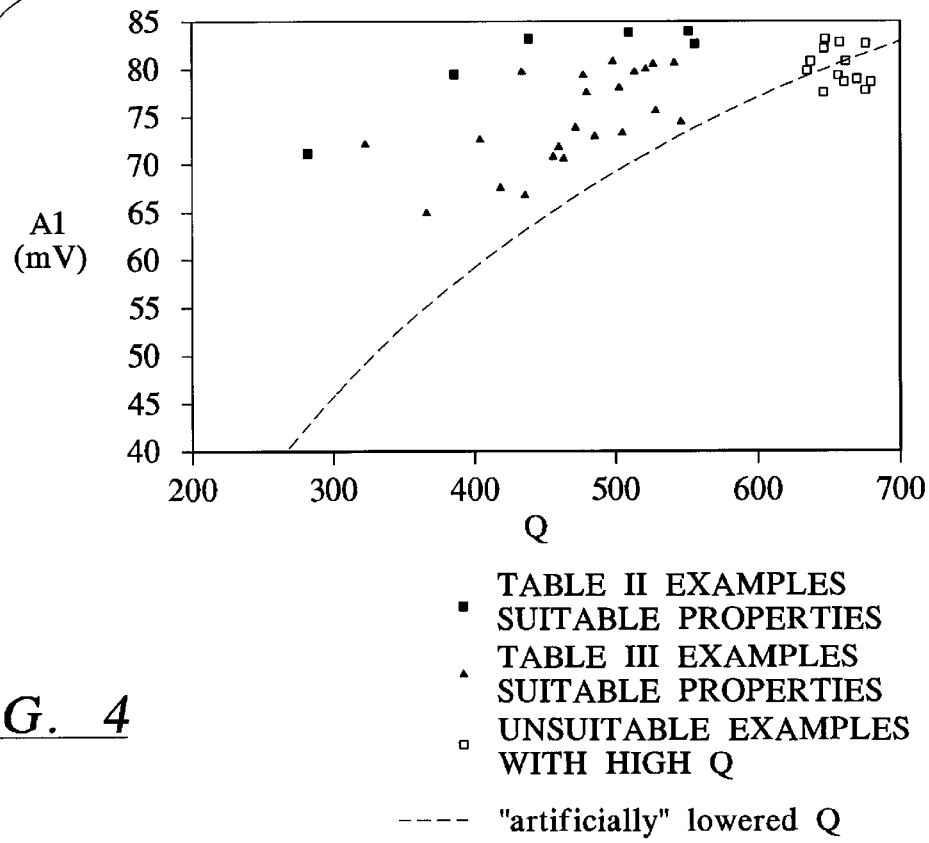
FIG. 4

AMORPHOUS MAGNETOSTRICTIVE ALLOY AND AN ELECTRONIC ARTICLE SURVEILLANCE SYSTEM EMPLOYING SAME

BACKGROUND OF THE INVENTION

1. Field of the Invention

The present invention is directed to an amorphous magnetostrictive alloy for use in a marker employed in a magnetomechanical electronic article surveillance system. The present invention is also directed to a magnetomechanical electronic article surveillance system employing such a marker, as well as to a method for making the amorphous magnetostrictive alloy and a method for making the marker.

2. Description of the Prior Art

Various types of electronic article surveillance systems are known having the common feature of employing a marker or tag which is affixed to an article to be protected against theft, such as merchandise in a store. When a legitimate purchase of the article is made, the marker can either be removed from the article, or converted from an activated state to a deactivated state. Such systems employ a detection arrangement, commonly placed at all exits of a store, and if an activated marker passes through the detection system, this is detected by the detection system and an alarm is triggered.

One type of electronic article surveillance system is known as a harmonic system. In such a system, the marker is composed of ferromagnetic material, and the detector system produces an electromagnetic field at a predetermined frequency. When the magnetic marker passes through the electromagnetic field, it disturbs the field and causes harmonics of the predetermined frequency to be produced. The detection system is tuned to detect certain harmonic frequencies. If such harmonic frequencies are detected, an alarm is triggered. The harmonic frequencies which are generated are dependent on the magnetic behavior of the magnetic material of the marker, specifically on the extent to which the B-H loop of the magnetic material deviates from a linear B-H loop. In general, as the non-linearity of the B-H loop of the magnetic material increases, more harmonics are generated. A system of this type is disclosed, for example, in U.S. Pat. No. 4,484,184.

Such harmonic systems, however, have two basic problems associated therewith. The disturbances in the electromagnetic field produced by the marker are relatively short-range, and therefore can only be detected within relatively close proximity to the marker itself. If such a harmonic system is used in a commercial establishment, therefore, this means that the passageway defined by the electromagnetic transmitter on one side and the electromagnetic receiver on the other side, through which customers must pass, is limited to a maximum of about 3 feet. A further problem associated with such harmonic systems is the difficulty of distinguishing harmonics produced by the ferromagnetic material of the marker from those produced by other ferromagnetic objects such as keys, coins, belt buckles, etc.

Consequently, another type of electronic article surveillance system has been developed, known as a magnetomechanical system. Such a system is described, for example, in U.S. Pat. No. 4,510,489. In this type of system, the marker is composed of an element of magnetostrictive material, known as a resonator, disposed adjacent a strip of magnetizable material, known as a biasing element. Typically (but not necessarily) the resonator is composed of amorphous ferromagnetic material and the biasing element is composed of crystalline ferromagnetic material. The marker is activated by magnetizing the bias element and is deactivated by demagnetizing the bias element.

In such a magnetomechanical system, the detector arrangement includes a transmitter which transmits pulses in the form of RF bursts at a frequency in the low radio-frequency range, such as 58 kHz. The pulses (bursts) are emitted (transmitted) at a repetition rate of, for example 60 Hz, with a pause between successive pulses. The detector arrangement includes a receiver which is synchronized (gated) with the transmitter so that it is activated only during the pauses between the pulses emitted by the transmitter. The receiver "expects" to detect nothing in these pauses between the pulses. If an activated marker is present between the transmitter and the receiver, however, the resonator therein is excited by the transmitted pulses, and will be caused to mechanically oscillate at the transmitter frequency, i.e., at 58 kHz in the above example. The resonator emits a signal which "rings" at the resonator frequency, with an exponential decay time ("ring-down time"). The signal emitted by the activated marker, if it is present between the transmitter and the receiver, is detected by the receiver in the pauses between the transmitted pulses and the receiver accordingly triggers an alarm. To minimize false alarms, the detector usually must detect a signal in at least two, and preferably four, successive pauses.

In order to further minimize false alarms, such as due to signals produced by other RF sources, the receiver circuit employs two detection windows within each pause. The receiver integrates any 58 kHz signal (in this example) which is present in each window, and compares the integration results of the respective signals integrated in the windows. Since the signal produced by the marker is a decaying signal, if the detected signal originates from a resonator in a marker it will exhibit decreasing amplitude (integration result) in the windows. By contrast, an RF signal from another RF source, which may coincidentally be at, or have harmonics at, the predetermined resonant frequency, would be expected to exhibit substantially the same amplitude (integration result) in each window. Therefore, an alarm is triggered only if the signal detected in both windows in a pause exhibits the aforementioned decreasing amplitude characteristic in each of a number of successive pauses.

For this purpose. as noted above, the receiver electronics is synchronized by a synchronization circuit with the transmitter electronics. The receiver electronics is activated by the synchronization circuit to look for the presence of a signal at the predetermined resonant frequency in a first activation window of about 1.7 ms after the end of each transmitted pulse. For reliably distinguishing the signal (if it originated from the resonator) integrated within this first window from the signal integrated in the second window, a high signal amplitude is desirable in the first window. Subsequently, the receiver electronics is deactivated, and is then re-activated in a second detection window at approximately 6 ms after the original resonator excitation, in order to again look for and integrate a signal at the predetermined resonant frequency. If such a signal is integrated with approximately the same result as in the first detection window, the evaluation electronics assumes that the signal detected in the first window did not originate from a marker, but instead originated from noise or some other external RF source. An alarm therefore is not triggered.

PCT Applications WO 96/32731 and WO 96/32518, corresponding to U.S. Pat. No. 5,469,489, disclose a glassy metal alloy consisting essentially of the formula $Co_aFe_bNi_cM_dB_eSi_fC_g$, wherein M is selected from molybdenum and chromium and a, b, c, d, e, f and g are at %, a ranges from about 40 to about 43, b ranges from about 35 to about 42, c ranges from 0 to about 5, d ranges from 0 to about 3, e ranges from about 10 to about 25, f ranges from 0 to about 15 and g ranges from 0 to about 2. The alloy can be cast by rapid solidification into ribbon, annealed to enhance the magnetic properties thereof, and formed into a marker that is especially suited for use in magnetomechanically actuated article surveillance systems. The marker is characterized by relatively linear magnetization response in a frequency regime wherein harmonic marker systems operate magnetically. Voltage amplitudes detected for the marker are high, and interference between surveillance systems based on mechanical resonance and harmonic re-radiance is precluded.

U.S. Pat. No. 5,469,140 discloses a ribbon-shaped strip of an amorphous magnetic alloy which is heat treated, while applying a transverse saturating magnetic field. The treated strip is used in a marker for a pulsed-interrogation electronic article surveillance system. A preferred material for the strip is formed of iron, cobalt, silicon and boron with the proportion of cobalt exceeding 30 at %.

U.S. Pat. No. 5,252,144 proposes that various magnetostrictive alloys be annealed to improve the ring-down characteristics thereof. This patent, however, does not disclose applying a magnetic field during heating.

Notwithstanding these attempts, a magnetostrictive marker for use in a magnetomechanical article surveillance system which has optimum characteristics for use in such a system, and which is "invisible" to a harmonic system, has yet to be developed.

A problem with the characteristics of conventional resonators which have heretofore been employed in such magnetomechanical systems is that they have been designed to produce a relatively high signal amplitude immediately upon being driven by the transmitted pulse, in order to facilitate integration in the first detection window. This results in the resonator signal having a relatively long ring-down (decay) time, and therefore the resonator signal still has a relatively high amplitude at the time the second detection window occurs. The detection sensitivity (reliability) of the overall surveillance system is directly dependent on the difference in amplitude (integration result) of the resonator signal in these two successive detection windows. If the signal decay time is relatively slow the difference in amplitude (integration result) of the resonator signal in the two detection windows may become small enough so as to fall within a normal variation range for spurious signals. If the detector system is set (adjusted) so as to ignore such small differences as an alarm-triggering criterion, then a signal which truly originates from a marker, and thus should trigger an alarm, would fail to do so. Alternatively, if the system is adjusted so as to treat such relatively small differences as a condition for triggering an alarm, this will increase the frequency of false alarms.

Since both harmonic and magnetomechanical systems are present in the commercial environment, a further problem is known as "pollution," which is the problem of a marker designed to operate in one type of system producing a false alarm in the other type of system. This most commonly occurs by a conventional marker intended for use in a magnetomechanical system triggering a false alarm in a harmonic system.

This arises because, as noted above, the marker in a harmonic system produces the detectable harmonics by virtue of having a non-linear B-H loop. A marker with a linear B-H loop would be "invisible" to a harmonic surveillance system. A non-linear B-H loop, however, is the "normal" type of B-H loop exhibited by magnetic material; special measures have to be taken in order to produce material which has a linear B-H loop.

A further desirable feature of a resonator for use in a marker in a magnetomechanical surveillance system is that the resonant frequency of the resonator have a low dependency on the pre-magnetization field strength produced by the bias element. The bias element is used to activate and deactivate the marker, and thus is easily magnetizable and demagnetizable. When the bias element is magnetized in order to activate the marker, the precise field strength of the magnetic field produced by the bias element cannot be guaranteed. Therefore, it is desirable that, at least within a designated field strength range, the resonant frequency of the resonator not change significantly for different magnetization field strengths. This means $df_r/dH_b$ should be small, wherein $f_r$ is the resonant frequency, and $H_b$ is the strength of the magnetization field produced by the bias element.

Upon deactivation of the marker, however, it is desirable that a very large change in the resonant frequency occur upon removal of the magnetization field. This ensures that a deactivated marker, if left attached to an article, will resonate, if at all, at a resonant frequency far removed from the resonant frequency that the detector arrangement is designed to detect.

Lastly, the material used to make the resonator must have mechanical properties which allow the resonator material to be processed in bulk, usually involving a thermal treatment (annealing) in order to set the magnetic properties. Since amorphous metal is usually cast as a continuous ribbon, this means that the ribbon must exhibit sufficient ductility so as to be processable in a continuous annealing furnace, which means that the ribbon must be unrolled from a supply reel, passed through the annealing furnace, and possibly rewound after annealing. Moreover, the annealed ribbon is usually cut into small strips for incorporation of the strips into markers, which means that the material must not be overly brittle and its magnetic properties, once set by the annealing process, must not be altered or degraded by cutting the material.

SUMMARY OF THE INVENTION

It is an object of the present invention to provide a magnetostrictive amorphous metal alloy for incorporation in a marker in a magnetomechanical surveillance system which can be cut into an oblong, ductile, magnetostrictive strip which can be activated and deactivated by applying or removing a pre-magnetization field $H_b$ and which, in the activated condition, can be excited by an alternating magnetic field so as to exhibit longitudinal, mechanical resonance oscillations at a resonant frequency $f_r$ which are initially, after excitation, of a relatively high signal amplitude but which decay relatively rapidly thereafter.

Specifically, it is an object of the present invention to provide such a magnetostrictive amorphous alloy which, when excited, produces oscillations at the resonant frequency of a sufficiently high amplitude to be reliably detected in a first detection window in the magnetomechanical surveillance system and which have decayed in amplitude to a sufficiently large extent by the time the second detection window occurs, so that the oscillations originating from the marker can be reliably distinguished from spurious signals.

It is a further object of the present invention to provide such an alloy wherein only a slight change in the resonant frequency $f_r$ occurs given a change in the magnetization field strength.

A further object is to provide such an alloy wherein the resonant frequency $f_r$ changes significantly when the marker resonator is switched from an activated condition to a deactivated condition.

Another object of the present invention is to provide such an alloy which, when incorporated in a marker for a magnetomechanical surveillance system, does not trigger an alarm in a harmonic surveillance system.

The above object is achieved in accordance with the principles of the present invention in a resonator composed of an amorphous, magnetostrictive alloy having the general formula $$Fe_aCo_bNi_cSi_xB_y$$

wherein a, b, c, x and y are at % and wherein in a preferred alloy set, $15<a<30$ $79<a+b+c<85$ $b>12$ $30<c<50$ with x and y comprising the remainder, so that $a+b+c+x+y=100$, and wherein the activated resonator has a resonator quality $100<Q<600$, a linear B-H loop up to a minimum field of about 8 Oe, an anisotropy field of at least about 10 Oe, and produces a signal at about 7 ms following excitation having at least a 15 dB amplitude decrease at compared to the amplitude of the signal about 1 ms after the resonator is excited to resonate.

Moreover, typically 0<x 8 and 10<y<21.

In the above range designations, and as used elsewhere herein, all numerical lower and upper designations should be interpreted as including the value of the designation itself and as if preceded by "about", i.e., small variations from the literally specified designations are tolerable.

Preferred embodiments of the alloy for producing ribbon which is one-half inch in width are $Fe_{24}Co_{16}Ni_{42}Si_2B_{16}$ and $Fe_{24}Co_{16}Ni_{42.7}Si_{1.5}B_{15.5}C_{0.3}$ and $Fe_{25}Co_{15}Ni_{43.5}Si_1B_{15.5}$, and preferred embodiments for making ribbon which is 6 mm in width are $Fe_{24}Co_{18}Ni_{40}Si_2B_{16}$ and $Fe_{24}Co_{18}Ni_{40.7}Si_{1.5}B_{15.5}C_{0.3}$ and $Fe_{25}Co_{17}Ni_{40.5}Si_{1.5}B_{16}$. (Carbon is not listed in the initially-cited general inventive formulation, but may be present in very small amounts. Since it behaves as boron, it may be considered to be subsumed within designated boron contents.)

The above resonator produces a signal, which in addition to the above attributes is damped (decays) by no more than 15 dB. and preferably by no more than 10 dB, at 1 ms after the resonator is excited compared to the amplitude of the signal immediately after excitation.

The alloy is prepared by rapid quenching from the melt to produce an amorphous ribbon, with the ribbon then being subjected to a heat treatment by annealing the ribbon in a temperature range of 300° C. and 400° C., for a time below 60 seconds, while simultaneously subjecting the ribbon to a transverse magnetic field, i.e., a magnetic field having a direction which is substantially perpendicular to the longitudinal (longest) extent of the ribbon, and in the plane of the ribbon.

As noted above, the annealed alloy forming a resonator having the above composition has a linear B-H loop up to the saturation region and the anisotropy field strength $H_k$ is at least approximately 80 A/m, which is approximately 10 Oe. This results in a marker having strip cut from the ribbon which does not trigger an alarm in a harmonic surveillance system, due to the magnetic anisotropy being set transversely to the strip.

The mechanical oscillation signal A(t) produced by a strip cut from such a ribbon, when driven by a transmitted pulse in a magnetomechanical surveillance system, has the form $$A(t)=A(0)\cdot\exp(-t\cdot\pi\cdot f_r/Q)$$

wherein A(0) is an initial amplitude and Q is the quality of the resonator. The inventive alloy has been designed based on a recognition that, in order for the signal produced by the resonator to initially have the desired high signal amplitude, followed by a relatively rapid decay, Q should be below approximately 500–600, but should be at least 100, preferably 200. The upper range limit for Q determines the maximum decay time (ring-down time) allowable to provide sufficient signal attenuation in the second detection window, and the lower range limit guarantees sufficient signal amplitude in the first detection window (when t is very small). An alloy having the above-identified composition has a Q within that range, and results in a drop in the signal amplitude of approximately 15 dB between the amplitude in the aforementioned first detection window and the amplitude in the aforementioned second detection window.

Resonators made with an alloy according to the above formula exhibit only a slight change in the resonant frequency $f_r$ given changes in the pre-magnetization field strength. Given a field strength $H_b$ in a range between 6 and 7 Oe, the change of the resonant frequency $f_r$ (expressed in terms of absolute value) for alloys having the above formula is $|df_r/dH_b|<700$ Hz/Oe.

The resonant frequency $f_r$ of alloys made according to the above formula changes by at least 1.2 kHz when the marker is switched from the activated condition to the deactivated condition. This is sufficiently large to reliably preclude the marker from producing a detectable signal in the deactivated condition.

Ribbon composed of an alloy according to the above formula, moreover, is sufficiently ductile to permit the ribbon to be wound and unwound, and to be cut into strips, without significantly altering the aforementioned properties.

A marker for use in a magnetomechanical surveillance system has a resonator composed of an alloy having the above formula and properties, contained in a housing adjacent a bias element composed of ferromagnetic material. Such a marker is suitable for use in a magnetomechanical surveillance system having a transmitter which emits successive RF bursts at a predetermined frequency, with pauses between the bursts, a detector tuned to detect signals at the predetermined frequency, a synchronization circuit which synchronizes operation of the transmitter circuit and the receiver circuit so that the receiver circuit is activated to look for a signal at the predetermined frequency in the pauses between the bursts, and an alarm which is triggered if the detector circuit detects a signal, which is identified as originating from a marker, within at least one of the pauses between successive pulses. Preferably the alarm is generated when a signal is detected which is identified as originating from a marker in more than one pause. Because of the aforementioned properties of the marker produced by the alloy having the formula described above, the ring-down time of the marker has appropriate characteristics so that the system can be set to trigger the alarm whenever it is appropriate to do so, while simultaneously substantially minimizing the triggering of false alarms.

DESCRIPTION OF THE DRAWINGS

FIG. 3 shows the relationship of the ratio between the signal amplitude in the first window and the signal amplitude in the second window, as a function of the resonator quality Q.

FIG. 4 shows the relationship of the signal amplitude in the first detection window to the resonator quality Q, with a dashed line showing the relationship when Q is reduced by artificial measures, and with values for various alloy compositions being shown with different symbols.

DESCRIPTION OF THE PREFERRED EMBODIMENTS

Figure 1:
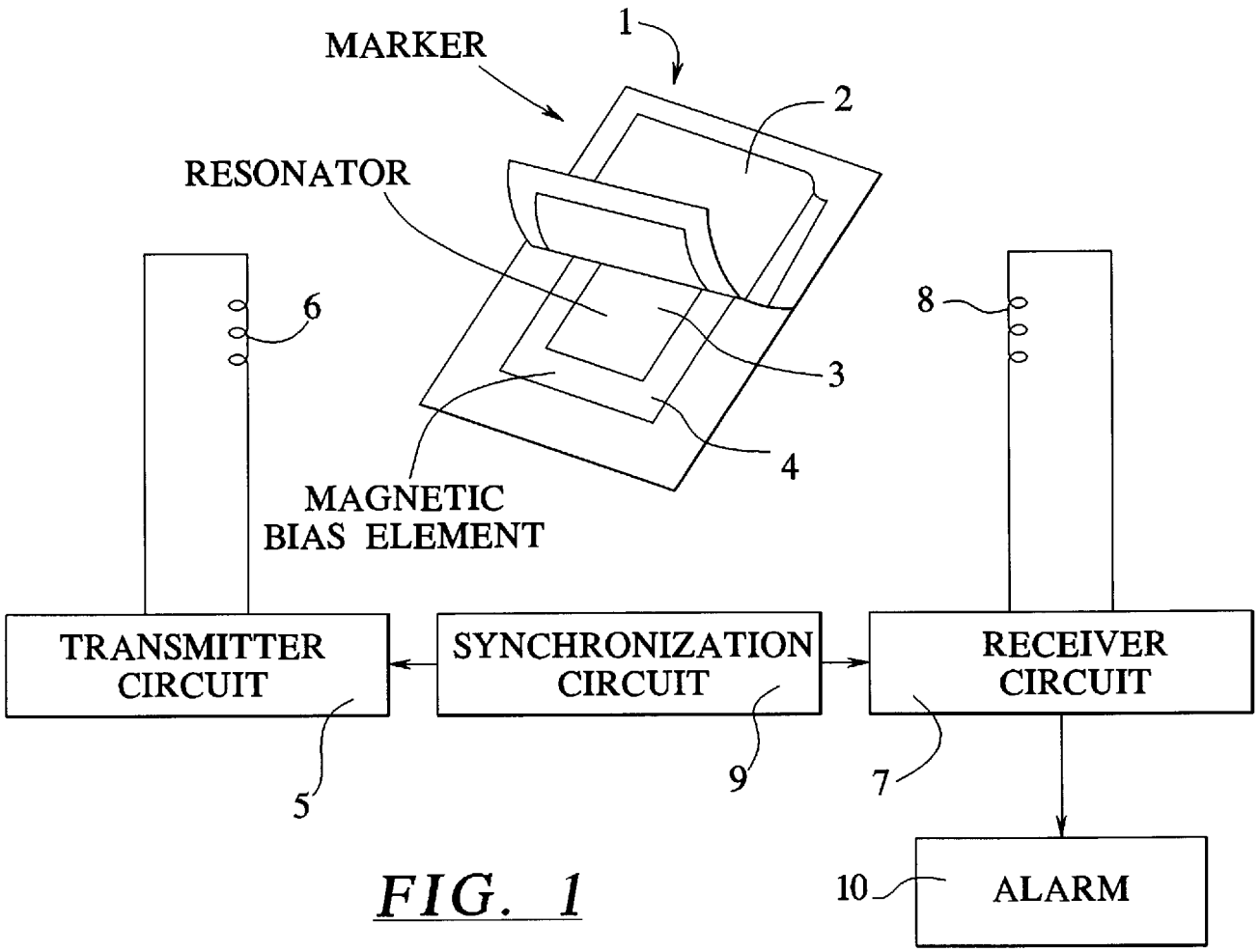
FIG. 1 shows a marker, with the upper part of its housing partly pulled away to show internal components, having a resonator made in accordance with the principles of the present invention, in the context of a schematically illustrated magnetomechanical article surveillance system.

FIG. 1 illustrates a magnetomechanical electronic surveillance system employing a marker 1 having a housing 2 which contains a resonator 3 and a magnetic bias element 4. The resonator 3 is cut from a ribbon of annealed amorphous magnetostrictive metal having a composition according to the formula $$Fe_aCo_bNi_cSi_xB_y$$

wherein a, b, c, x and y are at % and wherein in a preferred alloy set, $15<a<30$ $79<a+b+c<85$ $b>12$ $30<c<50$ with x and y comprising the remainder, so that $a+b+c+x+y=100$, and wherein the activated resonator has a resonator quality $100<Q<600$ and produces a signal having no more than about 15 db decrease at 1 ms after the resonator is excited to resonate and which has at least a 15 dB decrease at about 7 ms after excitation compared to the amplitude at about 1 ms after excitation. The resonator 3 has a quality Q in a range between 100 and 600, preferably below 500 and preferably above 200. The bias element 4 produces a premagnetization field $H_b$ having a field strength which is typically in a range between 1 and 10 Oe. At a field strength $H_b$ between approximately 6 and 7 Oe produced by the bias element 4, the resonator 3 exhibits a change in its resonant frequency $|df_r/dH_b|<700$ Hz/Oe. When the bias element 4 is demagnetized, thereby deactivating the marker 1, the resonant frequency of the resonator 3 changes at by at least 1.2 kHz. The resonator 3 has an anisotropy field $H_k$ of at least 10 Oe.

Moreover, the resonator 3 has a magnetic anisotropy which is set transversely to the longest dimension of the resonator 3, by annealing the ribbon from which the resonator 3 is cut in a transverse magnetic field substantially perpendicular to the longitudinal extent of the ribbon, and in the plane of the ribbon. This results in the resonator 3 having a linear B-H loop in the expected operating range of between 1 and 8 Oe.

Additionally, the resonator 3 produces a signal which can be substantially unambiguously identified as originating from the marker 1 in the surveillance system shown in FIG. 1.

Figure 2:
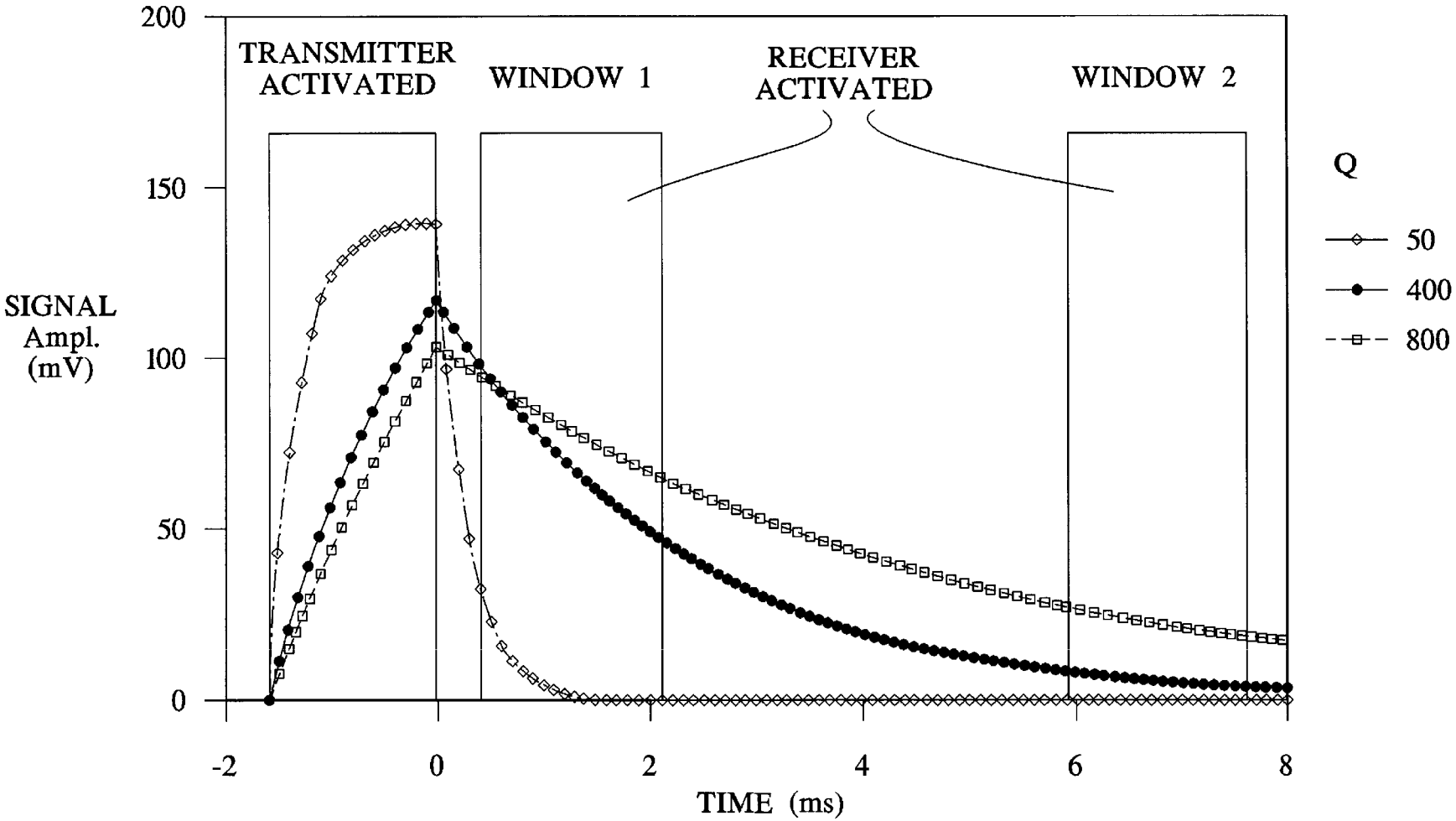
FIG. 2 illustrates the signals produced by different markers with different values of Q upon being driven and detected in a magnetomechanical electronic surveillance system.

The magnetomechanical surveillance system shown in FIG. 1 operates in a known manner. The system, in addition to the marker 1, includes a transmitter circuit 5 having a coil or antenna 6 which emits (transmits) RF bursts at a predetermined frequency, such as 58 kHz, at a repetition rate of, for example, 60 Hz, with pauses between each burst. The transmitter circuit 5 is controlled to emit the aforementioned RF bursts by a synchronization circuit 9, which also controls a receiver circuit 7 having a reception coil or antenna 8. If an activated marker 1 (i.e., a marker 1 having a magnetized bias element 4) is present between the coils 6 and 8 when the transmitter circuit 5 is activated, the RF burst emitted by the coil 6 will drive the resonator 3 to oscillate at the resonant frequency of 58 kHz (in this example), thereby generating a signal of the type shown in FIG. 2. FIG. 2 shows various signals for different values of the resonator quality Q.

The synchronization circuit 9 controls the receiver circuit 7 so as to activate the receiver circuit 7 to look for a signal at the predetermined frequency 58 kHz (in this example) within a first detection window, designated window1 in FIG. 2. A reference time of t=0 is arbitrarily shown in FIG. 2, with the transmitter circuit 5 having been activated by the synchronization circuit 9 to emit an RF burst having a duration of about 1.6 ms. The time t=0 has been chosen in FIG. 2 to coincide with the end of this burst. At approximately 0.4 ms after t=0, the receiver circuit 7 is activated in window1. During window1 (which lasts about 1.7 ms), the receiver circuit 7 integrates any signal at the predetermined frequency, such as 58 kHz, which is present. In order for the signal in this window1 to produce a significant integration result, the signal emitted by the marker 1 should have a relatively high initial amplitude upon excitation, preferably above approximately 100 mV and should decay by no more than about 15 dB, preferably by no more than about 10 dB, at about 1 ms after excitation, compared to its initial amplitude. This means the signal should have a minimum amplitude of about 40 mV near a center of window1. The inventive resonator produces a signal fulfilling all of these criteria. Signals respectively produced by resonators having Q=50, Q=400 and Q=800 are entered in FIG. 2. For testing, a signal representative of the window1 signal (A1) was measured 1 ms after excitation and a signal representative of window2 (A2) was measured 7 ms after excitation. These are times which fall in the centers of the respective windows.

Subsequently, the synchronization circuit 9 deactivates the receiver circuit 7, and re-activates the receiver circuit 7 during a second detection window also lasting 1.7 ms, designated window2 in FIG. 2. During window2, the receiver circuit 7 again integrates any signal at the predetermined frequency (58 kHz). If the signal at this frequency is integrated in window2 so as to produce an integration result indicative (at this time) of a non-decaying signal, electronic circuitry contained in the receiver circuit 7 will assume that the signal originated from a source other than an activated marker 1.

It is therefore important that the amplitude of the signal in the second detection window be of an optimum magnitude, i.e., it must not be too high so as to be mistaken as originating from a source other than the marker 1, but it must be sufficiently low so as to be easily distinguishable from the signal in the first window. As can be seen in FIG. 2, the signal generated by a resonator having Q=50 has such a rapid decay (ring-down time) as to already exhibit an extremely low amplitude in the first detection window. A resonator having Q=800, however, as shown in FIG. 2 still exhibits a relatively high amplitude in the second detection window. A signal generated by the inventive resonator 3, having Q=400, exhibits a signal amplitude in each of window1 and window2 which is sufficient to ensure reliable detection, but the signal amplitude difference between window1 and window2 is sufficiently large to allow reliable identification of the signal as originating from an activated marker 1.

FIG. 2 illustrates the relationship between the resonator quality Q and the ratio of the signals respectively detected in window1 and window2. As this relationship decreases, assurance is increased that an optimally high detection rate and a minimum of false alarms will result. In practice, a minimum attenuation of the signal ratio between the signals arising in window1 and window2 of approximately 15 dB is preferable. This means that the resonator quality Q should be below 600, and preferably below 550. A resonator quality Q of at least 100, and preferably 200, is needed, however, in order to obtain an adequate signal amplitude in the first detection window.

When the receiver circuit 7 detects a signal in each of window1 and window2 that satisfies the above criterion, an alarm 10 is triggered. As a further protection against false alarms, the receiver circuit 7 can be required to detect signals which satisfy the aforementioned criteria in a predetermined number of successive pauses between the bursts emitted by the transmitter circuit 5, such as four successive pauses.

False alarms can also be generated due to a marker 1 which has been ineffectively deactivated. This is because the resonator quality Q becomes extremely high in the presence of very low pre-magnetization field strengths, as occur when the marker 1 is deactivated, i.e, when the bias element 4 is demagnetized. Under such circumstances, the resonator quality Q will have values above 1,000, which means that the post-burst oscillation is extremely long. This means that the signal amplitudes in window1 and window2 of an ineffectively deactivated marker will not satisfy the aforementioned detection criteria, and thus no alarm will be triggered.

The resonator quality Q can be reduced by a number of different measures including "artificial" measures such as introducing mechanical friction, having a poor ribbon quality for the resonator 3 (such as, for example, holes therein), or the resonator thickness can be made very large, for example, 30–60 $\mu$m, which results in eddy currents being induced.

Such artificial measures, however, have disadvantageous side effects including, for example, simultaneously highly negatively affecting the signal amplitude. The dashed line shown in FIG. 4 represents the typical drop in the signal amplitude which occurs when the resonator quality Q is artificially or forcibly lowered by such measures. Such lowering of the signal amplitude, however, simultaneously reduces the detection sensitivity of the surveillance system.

Amorphous ribbons having a 6 mm ribbon width and a typical ribbon thickness of 25 $\mu$m, with different compositions, were cast, thermally treated in a transverse magnetic field, and their resonant behavior was investigated in a pre-magnetizing constant field of 6.5 Oe. To that end, strips which were 38 mm in length were excited with alternating field pulses of 1.6 ms duration, with 16 ms pauses between the pulses. This caused the strips to exhibit resonant oscillations in a range between 55 and 60 kHz, which was capable of being matched to 58 kHz by slight modification of the length of the strip. The quality Q was measured from the decay behavior of the oscillation signal as well as the signal amplitude (designated signal1 amplitude in FIG. 4) at 1 ms after removal of the exciting alternating field. The signal was detected with a pick-up coil having 100 turns.

Exemplary embodiments 1.A through 1.J in Table I show a number of alloys having a low resonator quality Q from the outset. These samples, however, do not meet the other demands made on the resonator material.

Examples 1.A and 1.B represent commercially obtainable alloys, which produced no measurable signal amplitude. This is presumably attributable to a quality Q which is too low, i.e., Q<100, and to a low value of the anisotropy field $H_k$ even though, at $H_k$=5.5 to 6 A/cm (approximately 7–8 Oe), this is just above the test field strength $H_b$=5.2 A/cm (=6.5 Oe).

Examples 1C through 1J exhibit a higher anisotropy field strength $H_k$ and a high signal amplitude in combination with a low quality. A disadvantage of these samples, however, is a high dependency of the resonant frequency $f_r$ on the precise value of the pre-magnetization field $H_b$. For these samples, the resonant frequency $f_r$ changes by 1 kHz or noticeably more than the test field strength $H_b$ changes by approximately 1 Oe. Such a change in the bias field $H_b$ can occur, for example, merely by a marker being differently oriented in the earth's magnetic field. The corresponding detuning of the resonant frequency considerably degrades accurate detection of a marker employing such strip.

The value of $|df_r/dH_b|$ generally can be modified by adjustment of the annealing temperature and the annealing time. For the same annealing temperature, generally a longer annealing time will yield lower values of $|df_r/dH_b|$. This is only true, however, within limits. The alloy samples in Table I, for example, were already annealed for 15 minutes at 350° C., which resulted in a $|df_r/dH_b|$ value very close to the achievable minimum.

For an economically practical implementation of the thermal treatment process, for example, a continuous thermal treatment process, thermal treatment times which are substantially below 1 minute, and preferably in the range of seconds, are desired. Such short thermal treatment times also ensure that the annealed material will still be sufficiently ductile after the thermal treatment so that it can be cut to length.

Tables II and III show alloy samples for which the desired, low-frequency change $|df_r/dH_b|$ was capable of being achieved. In all of these samples, the thermal treatment parameters were selected such that $|df_r/dH_b|$ exhibited an adequately low value of 550–650 Hz/Oe at 6.5 Oe.

As can be seen from the samples shown in Tables II and III, lower values for the quality Q arise as the iron content of the alloy becomes lower, and as the cobalt and/or nickel content of the alloy increases. A certain minimum iron content of approximately 15 at %, however, is necessary so that the material can still be excited to produce magnetoelastic oscillations with sufficiently high amplitude. Alloys with iron lower than approximately 15 at % exhibit no, or virtually no, magnetoresistive resonance, as exemplified by samples 1.K through 1.N in Table I.

None of the alloys in Table I are suitable for use as the resonator 3 because they lack one or more of the desired properties discussed above.

From the samples shown in Tables II and III, the following alloy samples represent advantageous exemplary embodiments suitable for use as a resonator 3, because they simultaneously achieve a quality Q below 500–600, exhibit a $|df_r/dH_b|$ value below 700 Hz/Oe, and a high signal amplitude.

Samples II.1–II-12 from Table II are cobalt-rich samples which are distinguished by a very high signal amplitude. Samples II.1–II.7 are preferred.

Examples III.1–III.31 from Table III all exhibit the aforementioned desired characteristics, with examples III.1–III.22 being preferred.

Examples II.A–II.C from Table II and samples III-.A–III.M from Table III are not suitable because they exhibit a quality Q which is greater than 600.

For comparison with the aforementioned dashed line curve representing an "artificial" lowering of Q, FIG. 4 shows that a reduced Q without significant loss of signal amplitude can be simultaneously achieved using the inventive alloy compositions. All of the examples represented in FIG. 4 exhibit a higher signal amplitude than the aforementioned unsuitable samples, when their quality Q is "artificially" lowered by mechanical damping, or by other measures unrelated to alloy composition.

TABLE I

| Sample | Constituents (at %) | | | | | $H_k$ | $\|df_r/dH_b\|$ | | A1 |
|---|---|---|---|---|---|---|---|---|---|
| Nr | Fe | Co | Ni | Si | B | (Oe) | (Hz/Oe) | Q | (mV) |
| I.A | 40 | | 38 | Mo 4 | 18 | 7.0 | 300 | 85 | 7 |
| I.B | 76 | | | 12 | 12 | 7.4 | 190 | 169 | 9 |
| I.C | 41.5 | | 41.5 | 1 | 16 | 11.3 | 1376 | 197 | 68 |
| I.D | 47.4 | 31.6 | | 2 | 19 | 15.6 | 1011 | 325 | 71 |
| I.E | 52 | | 30 | 2 | 16 | 13.9 | 1246 | 236 | 80 |
| I.F | 57 | | 25 | 2 | 16 | 13.7 | 1493 | 229 | 84 |
| I.G | 58 | | 25 | 1 | 16 | 14.6 | 1331 | 223 | 86 |
| I.H | 61.5 | 21.5 | | 1 | 16 | 19.1 | 981 | 337 | 73 |
| I.I | 62 | | 20 | 2 | 16 | 13.2 | 1718 | 137 | 60 |
| I.J | 66 | 18 | | 1 | 15 | 18.7 | 1084 | 236 | 74 |
| I.K | 4.7 | 72.8 | | 5.5 | 17 | no magnetoelastic resonance | | | |
| I.L | 7.5 | 57 | 17 | 2 | 16.5 | no magnetoelastic resonance | | | |
| I.M | 6.8 | 38.2 | 40 | 13 | 2 | no magnetoelastic resonance | | | |
| I.N | 9 | 10 | 64 | 1 | 16 | no magnetoelastic resonance | | | |

TABLE II

| | Constituents (at %) | | | | | $H_k$ | | A1 |
|---|---|---|---|---|---|---|---|---|
| Sample Nr | Fe | Co | Ni | Si | B | (Oe) | Q | (mV) |
| II.1 | 18 | 65 | | 1 | 16 | 11.1 | 281 | 71 |
| II.2 | 24 | 55 | | 6 | 15 | 11.6 | 385 | 79 |
| II.3 | 26 | 57 | | 1 | 16 | 14.5 | 438 | 83 |
| II.4 | 34 | 49 | | 1 | 16 | 16.9 | 509 | 84 |
| II.5 | 37 | 45 | | 3 | 15 | 16.9 | 550 | 84 |
| II.6 | 37 | 45 | | 5 | 13 | 16.8 | 550 | 84 |
| II.7 | 38 | 45 | | 1 | 16 | 18.7 | 555 | 82 |
| II.8 | 41 | 41 | | 2 | 16 | 19.5 | 586 | 82 |
| II.9 | 41.5 | 41.5 | | 1 | 16 | 17.8 | 554 | 85 |
| II.10 | 43.5 | 39.5 | | 1 | 16 | 18.8 | 560 | 83 |
| II.11 | 45 | 38 | | 1 | 16 | 21.2 | 598 | 80 |
| II.12 | 45 | 35 | 3 | 1 | 16 | 20.4 | 595 | 81 |
| | | UNSUITABLE EXAMPLES | | | | | | |
| II.A | 46.5 | 31.5 | 5 | 1 | 16 | 20.4 | 612 | 81 |
| II.B | 49 | 31.5 | 2.5 | 1 | 16 | 21.0 | 627 | 81 |
| II.C | 51.5 | 31.5 | | 1 | 16 | 21.7 | 636 | 81 |

TABLE III

| Sample Nr. | Fe | Co | Ni | Si | B | $H_k$ (Oe) | Q | A1 (mV) |
|---|---|---|---|---|---|---|---|---|
| III.1 | 19 | 22 | 42 | 1 | 16 | 10.1 | 365 | 65 |
| III.2 | 21 | 20 | 42 | 1 | 16 | 10.7 | 418 | 68 |
| III.3 | 21 | 20 | 41 | 2 | 16 | 10.4 | 435 | 67 |
| III.4 | 21.5 | 41.5 | 20 | 1 | 16 | 11.3 | 321 | 72 |
| III.5 | 23 | 20 | 40 | 1 | 16 | 11.7 | 403 | 73 |
| III.6 | 24 | 16 | 43 | 1 | 16 | 11.6 | 456 | 71 |
| III.7 | 24 | 16 | 42 | 2 | 16 | 11.3 | 462 | 71 |
| III.8 | 24 | 18 | 40 | 2 | 16 | 11.4 | 459 | 72 |
| III.9 | 24 | 22 | 35 | 3 | 16 | 11.6 | 471 | 74 |
| III.10 | 25 | 20 | 38 | 1 | 16 | 12.2 | 485 | 73 |
| III.11 | 25 | 20 | 37 | 2 | 16 | 12.0 | 505 | 73 |
| III.12 | 26.5 | 41.5 | 15 | 1 | 16 | 13.9 | 433 | 80 |
| III.13 | 27 | 27 | 27 | 3 | 16 | 13.2 | 502 | 78 |
| III.14 | 28 | 20 | 34 | 2 | 16 | 13.2 | 528 | 76 |
| III.15 | 28 | 16 | 38 | 2 | 16 | 12.8 | 546 | 75 |
| III.16 | 28.5 | 31.5 | 20 | 4 | 16 | 13.6 | 540 | 81 |
| III.17 | 29 | 27 | 27 | 1 | 16 | 13.9 | 479 | 78 |
| III.18 | 29.5 | 39.5 | 10 | 6 | 16 | 13.0 | 476 | 80 |
| III.19 | 30.5 | 31.5 | 20 | 2 | 16 | 14.7 | 526 | 81 |
| III.20 | 31.5 | 41.5 | 10 | 1 | 16 | 16.4 | 498 | 81 |
| III.21 | 31.5 | 31.5 | 20 | 1 | 16 | 15.4 | 513 | 80 |
| III.22 | 31.5 | 31.5 | 20 | 1 | 16 | 15.2 | 521 | 80 |
| III.23 | 32.5 | 20 | 30 | 1 | 16.5 | 15.2 | 570 | 77 |
| III.24 | 35 | 17.5 | 30 | 1 | 16.5 | 15.9 | 597 | 77 |
| III.25 | 36 | 13 | 34 | 1 | 16 | 16.3 | 590 | 76 |
| III.26 | 36.5 | 36.5 | 10 | 1 | 16 | 18.2 | 544 | 80 |
| III.27 | 37.7 | 15.3 | 30 | 1.3 | 15.7 | 16.5 | 595 | 75 |
| III.28 | 40 | 15 | 30 | 1 | 14 | 17.7 | 591 | 75 |
| III.29 | 41 | 31 | 10 | 1 | 17 | 18.2 | 588 | 82 |
| III.30 | 41 | 31 | 10 | 2 | 16 | 18.5 | 595 | 81 |
| III.31 | 41.5 | 31.5 | 10 | 1 | 16 | 18.7 | 587 | 81 |
| | | UNSUITABLE EXAMPLES | | | | | | |
| III.A | 41 | 16 | 25 | 2 | 16 | 17.0 | 662 | 81 |
| III.B | 42 | 13 | 27.5 | 1 | 16.5 | 17.7 | 646 | 77 |
| III.C | 43 | 21 | 18 | 2 | 16 | 18.0 | 635 | 80 |
| III.D | 43 | 25 | 14 | 2 | 16 | 18.6 | 646 | 82 |
| III.E | 44 | 16 | 22 | 2 | 16 | 18.3 | 657 | 79 |
| III.F | 44.5 | 13 | 25 | 1.5 | 16 | 17.8 | 660 | 79 |
| III.G | 45 | 25 | 12 | 2 | 16 | 19.0 | 657 | 83 |
| III.H | 46 | 21 | 15 | 2 | 16 | 18.6 | 636 | 81 |
| III.I | 46 | 26 | 10 | 2 | 16 | 19.1 | 647 | 83 |
| III.J | 47 | 10 | 25 | 2 | 16 | 18.6 | 674 | 78 |
| III.K | 47 | 10 | 25 | 2 | 16 | 18.0 | 678 | 79 |
| III.L | 49.5 | 13 | 20 | 1.5 | 16 | 19.4 | 669 | 79 |
| III.M | 51 | 21 | 10 | 2 | 16 | 19.9 | 675 | 83 |

Further samples, having the compositions $Fe_{24}Co_{16}Ni_{42}Si_2B_{16}$ (Example III.7) and $Fe_{24}Co_{16}Ni_{42.7}Si_{1.5}B_{15.5}C_{0.3}$ and $Fe_{25}Co_{15}N_{43.5}Si_1B_{15.5}$ are suitable for ribbon which is about one-half inch in width, and $Fe_{24}Co_{18}Ni_{40}Si_2B_{16}$ (Example III.8) and $Fe_{24}Co_{18}Ni_{40.7}Si_{1.5}B_{15.5}C_{0.3}$ and $Fe_{25}Co_{17}Ni_{40.5}Si_{1.5}B_{16}$ are suitable for ribbon which is about 6 mm in width. Each of these compositions produces a resonator having the desired characteristics as initially described.

From the above tables, the following generalized formula characteristics can be ascertained. Alloys produced according to these generalizations all exhibit the aforementioned desired characteristics.

All of the following generalizations, moreover, are based on the aforementioned general formula $Fe_aCo_bNi_cSi_xB_y$.

The cobalt content can amount to a minimum of 32 at % and the iron content can be at least 15 at %. A preferred embodiment within this generalized description has a cobalt content of at least 43 at % and at most 55 at %. A further generalized set of alloys which exhibit the aforementioned properties has an iron content between 15 at % and 40 at %. One preferred embodiment within this generalized set has an iron content of at most 30 at %, a cobalt content of at least 15 at %, and a nickel content of at least 10 at %. Another preferred embodiment within this generalized set has a cobalt content between 12 and 20 at % and a nickel content between 30 and 45 at %.

A third generalized set of alloys has a nickel content between 30 at % and 53 at %, with the iron content being at least 15 at % and the cobalt content being at least 12 at %. Preferred embodiments within this generalized set of alloys have an iron content of at most 40 at %.

Lastly, another generalized set of alloys has a nickel content of at least 10 at %, an iron content of at least 15 at % but at most 42 at %, and a cobalt content between 18 and 32 at %.

Although the resonators disclosed herein have been prepared using alloys composed only of iron, cobalt, nickel, silicon and boron, it is understood by those knowledgeable in the field of amorphous metal that other elements, such as molybdenum, niobium, chromium and manganese can be included in small atomic percentages without significantly altering the aforementioned magnetic properties, and therefore alloys can be cast in accordance with the principles of the present invention which include very small percentages of such additional elements. Moreover, it is also known by those in the amorphous metals field that elements other than silicon, such as carbon and phosphorous, can be employed to promote glass formation, and therefore the resonators and alloys disclosed herein do not preclude the presence of such other glass formation-promoting elements.

Specifically, although not indicated in the above-designated compositions, the alloys made in accordance herewith can be expected to contain carbon in an amount between 0.2 and 0.6 at %. This small amount of carbon is introduced by virtue of the ferro-boron which contains carbon as an impurity, and by chemical reaction of the melt with the crucible material, which contains carbon. Since carbon behaves similarly to boron with respect to glass formation and magnetic properties, these very small amounts of carbon can be considered as being subsumed within the value of y for boron.

All of the ribbons from which the above samples were cut were cast in a conventional manner using a rotating chill wheel, with melt having the aforementioned compositions being fed to the circumference of the rotating wheel via a nozzle. The cast ribbons were continuously annealed (reel-to-reel annealing) in a 40 cm long laboratory furnace with a homogenous temperature zone of about 20 cm in length, at a typical annealing speed of about 0.2 m/min–4 m/min at temperatures in a range between about 300° C. and about 400° C. This corresponds to typical annealing times of between about 3 seconds and about 60 seconds at the annealing temperature. In a manufacturing-scale furnace with a homogenous temperature zone of about 1 meter in length, the annealing speed can be correspondingly higher (about 1 m/min to 20 m/min).

The annealing parameters for the samples in Tables II and III were adjusted so that the slope between 6 and 7 Oe fell between 550 Hz/Oe and 650 Hz/Oe. Typical annealing conditions for the samples in Tables II and III ranged between about 340° C. to about 380° C., with an annealing speed of about 1 to 3 m/min in the short laboratory furnace, or 5 m/min to 15 m/min in a manufacturing oven with a one meter long temperature zone.

Only the samples in Table I were batch-annealed for a considerably longer time, i.e., 15 min at 350° C., since the reel-to-reel annealing resulted in a slope which was too high. Even this prolonged annealing, however, was not capable of yielding the desired slope.

The magnetic field used during the annealing was transverse to the longitudinal direction of the ribbon and in the ribbon plane. The magnetic field had a strength of about 2 kOe in the laboratory furnace, and 1 kOe in the manufacturing furnace. The primary condition of the field strength is that it be sufficient to saturate the ribbon transverse to its ribbon (longitudinal) axis. Judging from the typical demagnetization factor across the ribbon width, a field strength of at least about several hundred Oe should be sufficient.

As noted above, all testing was performed on samples which were 38 mm long, 6 mm wide and about 25 $\mu$m thick. All ribbons in Tables II and III were sufficiently ductile so as to be cut without problem to the desired length.

Figure 5:
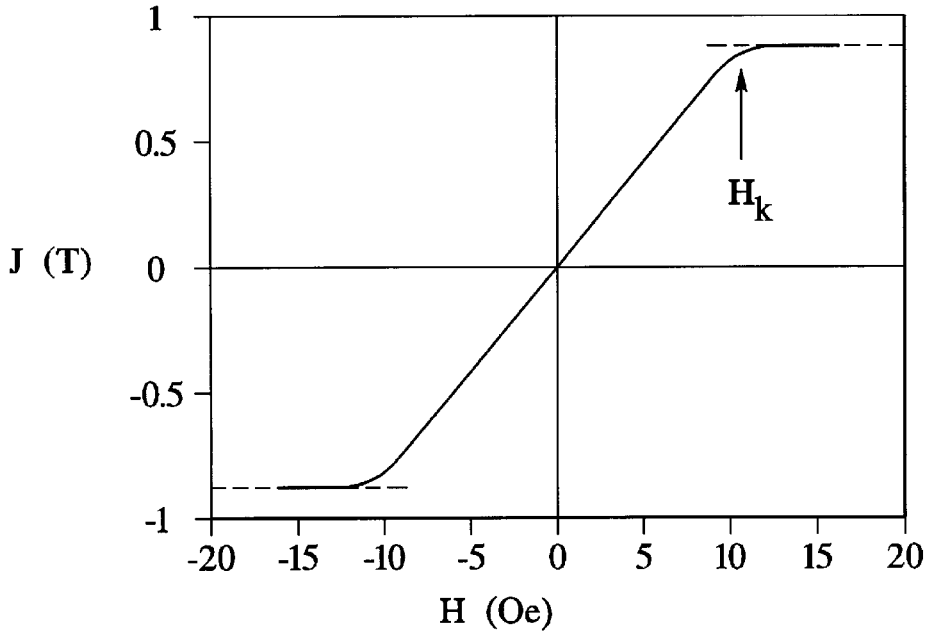
FIG. 5 illustrates a typical B-H loop exhibited by amorphous magnetostrictive ribbon made according to the principles of the present invention, after thermal treatment in a transverse magnetic field, with an ideal curve being shown in dashed lines and for explaining the definition of the anisotropy field strength $H_k$.

The strength of the anisotropy field $H_k$ was determined from the B-H loop recorded by a B-H loop tracer, as shown in FIG. 5. The sense coil system compensated for air flux, so that B=J can be assumed.

For determining the magnetoacoustic properties, the samples were excited (driven) to resonate at different bias fields by ac-field bursts of about 18 mOe peak amplitude. The on-time of the bursts was about one-tenth of the 60 Hz repetition rate, i.e., about 1.6 mm. The resonant amplitudes were measured at 1 ms and 2 ms after an individual burst was terminated, using a close-coupled receiver coil of 100 turns. The values A1 indicate the signal amplitude at 1 ms after termination of the burst. In general, $\mathbf{A1} \partial N \cdot W \cdot H_{ac}$ wherein N is the number of turns of the receiver coil, W is the width of the resonator and $H_{ac}$ is the field strength of the excitation (driving) field. The specific combination of these factors which produces A1 is not significant.

The resonator quality was calculated assuming an exponential decay of the signal (which was verified) from the amplitudes A1 and A2 respectively occurring at 1 ms and 2 ms after termination of each burst, according to the relation $$Q=\pi f_r/\ln(A1/A2).$$

The frequency versus bias slope was determined between 6 and 7 Oe, and the frequency shift upon deactivation was determined by observing the resonant frequency at 6.5 Oe (activated state) and 2 Oe (upper field limit for the deactivated state), and was calculated as the difference between the resonant frequencies at these field strengths.

FIGS. 5 through 8 illustrate the typical characteristics of the magnetic and magnetoelastic properties of a resonator made in accordance with the present invention. These curves are for a $Fe_{24}Co_{18}Ni_{40}Si_2B_{16}$ alloy annealed for about 6 s at 360° C. in a transverse field. The sample is 6 mm wide and 24 $\mu$m thick. The length was adjusted to 37.1 mm in order to produce a resonant frequency at precisely 58 kHz at 6.5 Oe. For illustrative purposes, the annealing conditions were intentionally selected so that the slope between 6 and 7 Oe bias field is at the upper limit of about 700 Hz/Oe and the anisotropy field $H_k$ is around the lower limit of about 10 Oe. Changing the annealing temperature to about 340° C. would readily yield a more desirable slope of about 600 Hz/Oe at the same annealing speed.

FIG. 5 shows the B-H loop recorded at 50 Hz. The dashed line shown in FIG. 5 is an ideal loop for a transverse anisotropy, for defining the anisotropy field $H_k$, and demonstrating the linearity of the loop up to approaching magnetic saturation, which occurs at about 10 Oe.

Figure 6:
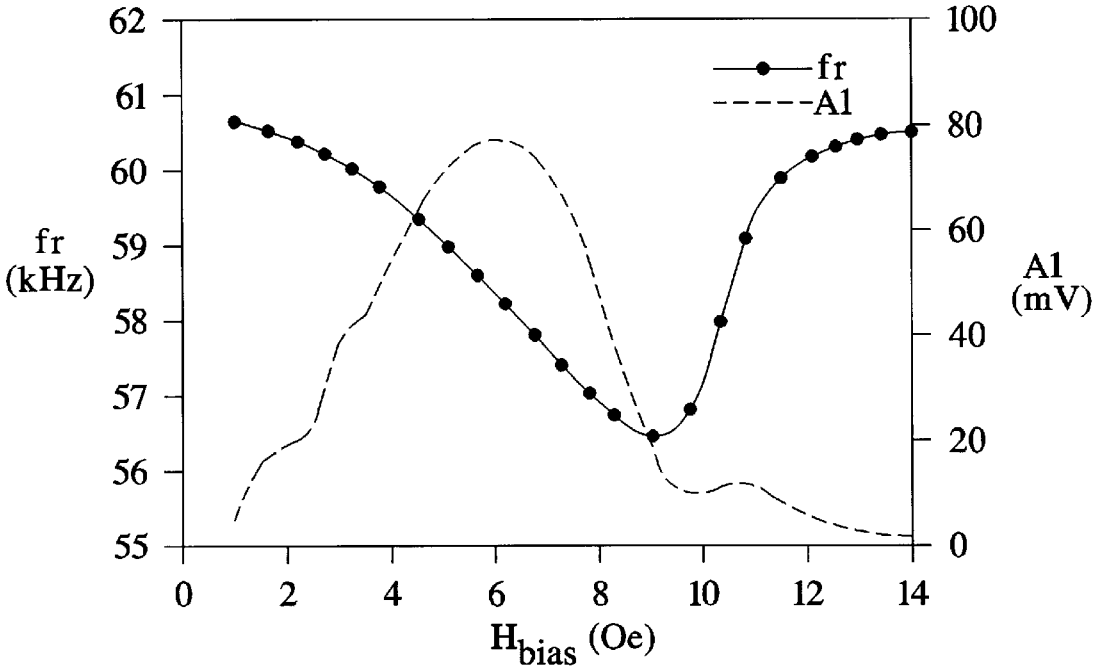
FIG. 6 shows the relationship between the resonant frequency and the signal amplitude as a function of the applied bias field, for a resonator made according to the principles of the present invention.
Figure 7:
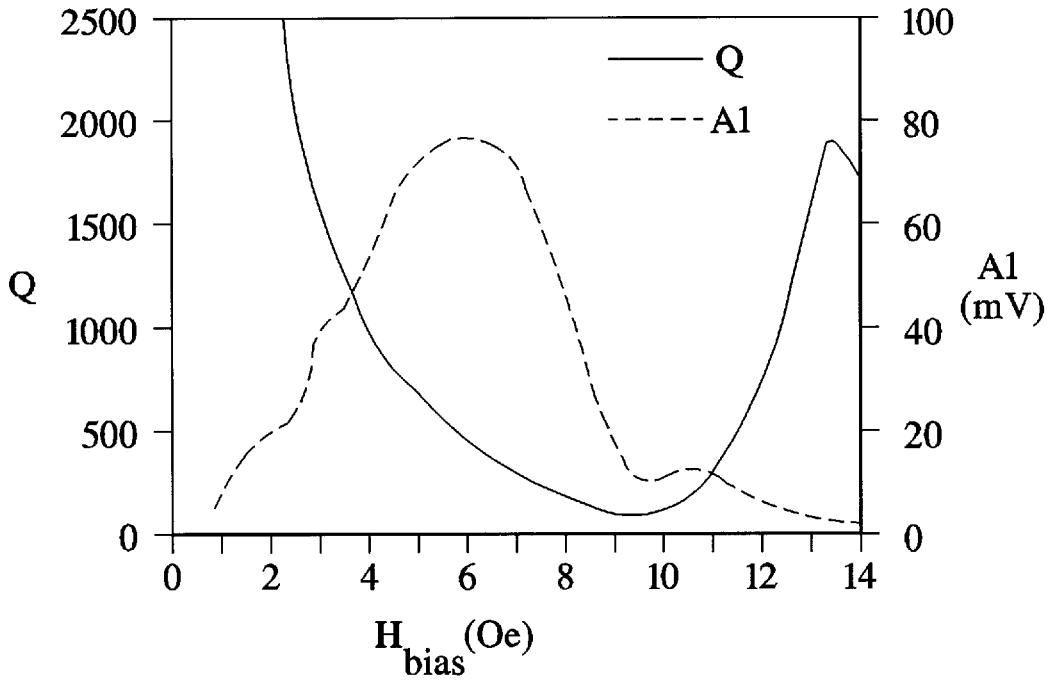
FIG. 7 illustrates the relationship between the resonator quality Q and the applied bias field in a resonator made according to the principles of the present invention.

FIG. 6 shows the resonant frequency and the resonant amplitude A1 of this sample as a function of the bias field. FIG. 7 shows the relationship between the Q value of this sample versus the bias field.

In the activated state, the resonator is biased with a magnetic field which is typically between 6 and 7 Oe. At this bias field strength, the resonator exhibits a high amplitude and a Q which is lower than 550. Typically the amplitude under the abovedescribed test conditions will be at a minimum of about 40 mV, in order to provide good detection in an interrogation system as described above.

The marker is deactivated by decreasing or eliminating the bias field, thereby increasing the resonant frequency, decreasing the amplitude, and increasing the Q. This is accomplished by demagnetizing the bias element 4.

As can be seen from FIG. 6, the resonant frequency depends upon the bias field strength. In practice, typical variations of the bias field from a target value (which is herein assumed to be 6.5 Oe) can be about ±0.5 Oe. These variations can arise from different orientations of the marker with respect to the earth's magnetic field, or from the property scatter of the bias element 4. The resonator material itself is also subject to scatter, and may not exhibit exactly the target frequency at the target bias field. For these reasons, the resonator 3 must be designed so that its frequency vs. bias slope is not too steep.

Figure 8:
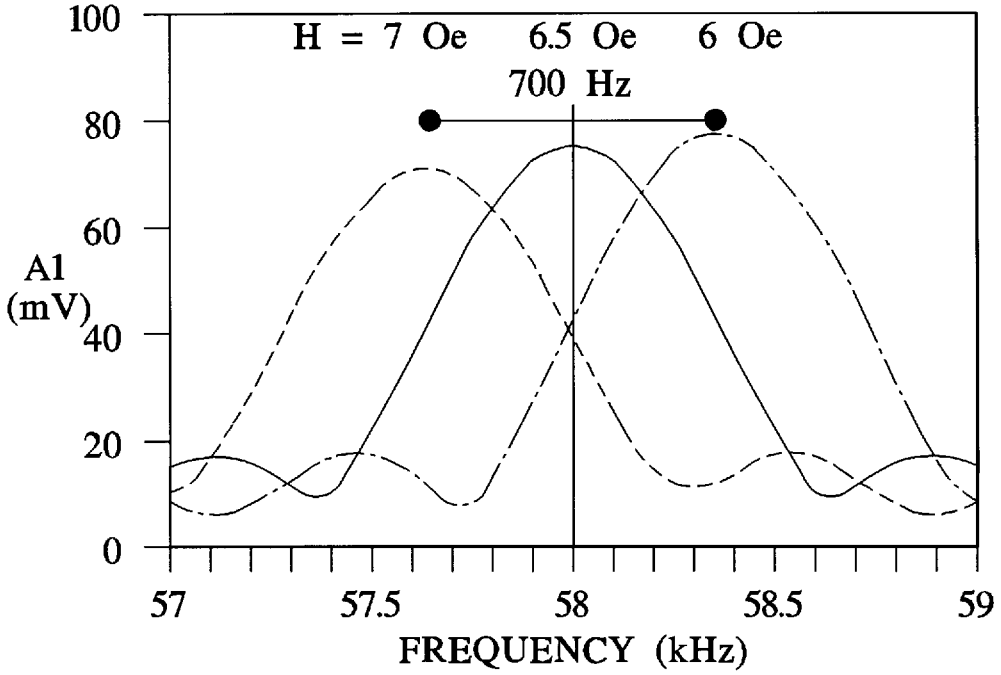
FIG. 8 shows the relationship between the signal amplitude and the frequency at a bias field of 6.5 Oe and bias fields 0.5 Oe above and below this value, for resonators made in accordance with the principles of the present invention.

FIG. 8 shows the resonant amplitude A1 against the frequency at a bias field of 6.5 Oe, and bias fields 0.5 Oe above and below this target value. Due to the finite bandwidth of the resonant curve (which is largely determined by the on-time of the acbursts and also by the resonator Q), the resonator 3 still shows a sufficient signal at the transmitter frequency of 58 kHz, even if the resonant frequency is not precisely hit. As illustrated in FIG. 8, the resonant signal A1 is still above approximately 40 mV if the frequency variation is about 700 Hz per 1 Oe variation in the bias field. Larger frequency variations are disadvantageous, smaller frequency variations are favorable. Correspondingly, the resonant curves of the activated marker should not be separated by more than about one-half of their amplitude bandwidth. Thus, the slope of the frequency vs. bias field curve $|df_r/dH_b|$ is preferably below about 700 Hz/Oe.

The variation of the frequency with the bias field is also one of the reasons why the bias field for activating the resonator 3 is between about 6 and 7 Oe. The bias field should be chosen so that the earth's magnetic field is at least less than approximately 10% of the field strength of the bias element 4. There is also an upper limit for $H_b$. More bias magnet material for the bias element 4 is needed in order to produce a larger $H_b$, which makes the marker more expensive. Secondly, a larger $H_b$ results in a larger magnetic attractive force between the bias element 4 and the resonator 3, which may introduce significant damping dependent on the orientation of the marker (magnetic attractive force vs. gravity). The optimum bias fields are thus located in approximately the 6–7 Oe range.

Figure 9:
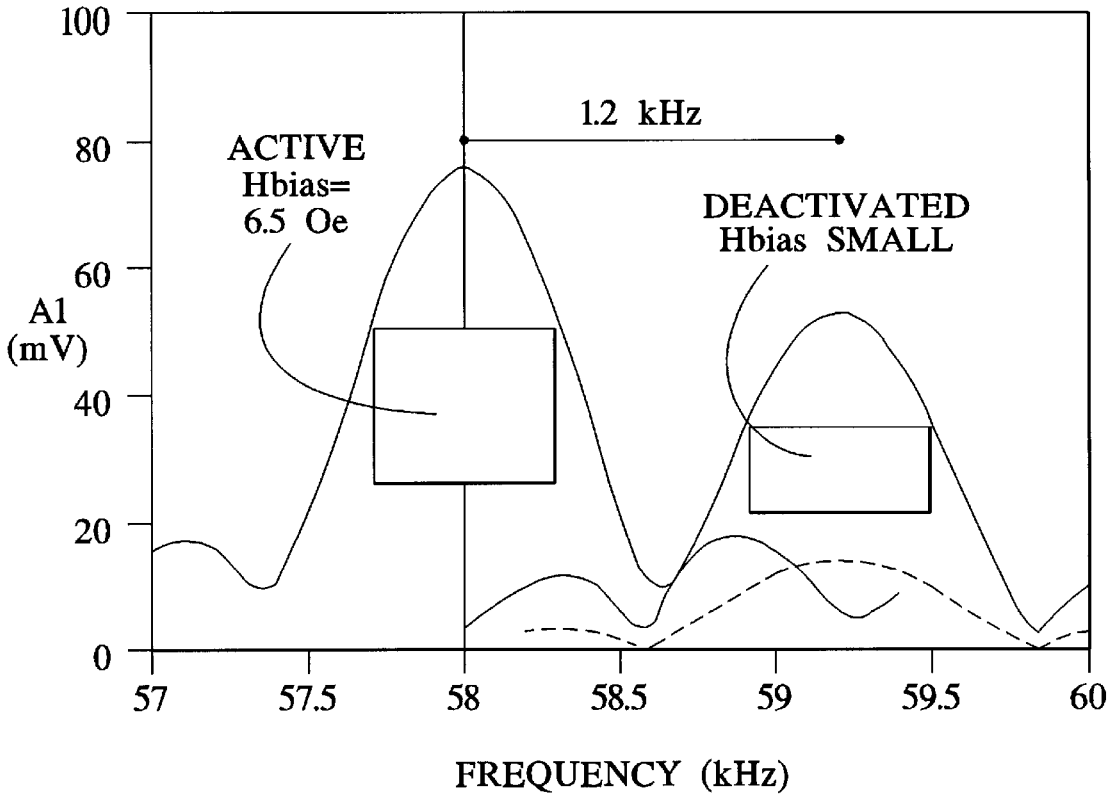
FIG. 9 illustrates the overlap of the resonant curves at different bias fields for illustrating the importance of the 1.2 kHz separation in the activated and deactivated states of a resonator made in accordance with the principles of the present invention.

As noted above, the resonant frequency of the resonator 3 should change significantly when the marker is deactivated by removing the bias field $H_b$. As illustrated in FIG. 9, the overlap of the resonant curves at different bias fields are sufficiently separated when the resonant frequency changes by at least about 1.2 kHz upon decreasing the bias field. The two curves are given for the deactivated state, and correspond to two different levels of the ac-burst field. The dashed curve is the ac field strength at 18 mOe, typically used in aforementioned standard test, while the other curve (for the deactivated state) corresponds to an increased drive field level as may occur in the interrogation zone of a magnetomechanical surveillance system close to the transmitter coil 6. The curve shown for the activated state was taken at the standard drive field strength of 18 mOe.

In practice, the deactivation is achieved by demagnetizing the bias element 4. Practically speaking, a "demagnetized" bias element 4 may still exhibit a small magnetization, thereby producing a bias field $H_b$ of about 2 Oe. Therefore, as a testing criterion, the frequency shift of the resonant frequency at 2 Oe compared against the resonant frequency at 6.5 Oe should be at least 1.2 kHz in order to guarantee that the resonator 3 will be properly deactivateable.

From the aforementioned data, however, as the slope $|df_r/dH_b$ becomes smaller, the frequency shift upon deactivation also becomes smaller. A slope which is too high will decrease the pick-rate, because the resonant frequency will be too far away from the predetermined value, however, a frequency shift which is too low upon deactivation will result in false alarms. Therefore, an optimum compromise must be reached, and such a compromise has been selected herein as adjusting the alloy composition and the thermal treatment so that the slope is about 550 Hz/Oe to 650 Hz/Oe, i.e., well below the limit of 700 Hz/Oe at which the pick-rate starts to be severely degraded. This ensures that a frequency shift which is larger than 1.6 kHz will be achieved, which is significantly above the important value for false alarms of 1.2 kHz, which would be correlated with a slope of about 400 Hz/Oe.

Figure 10:
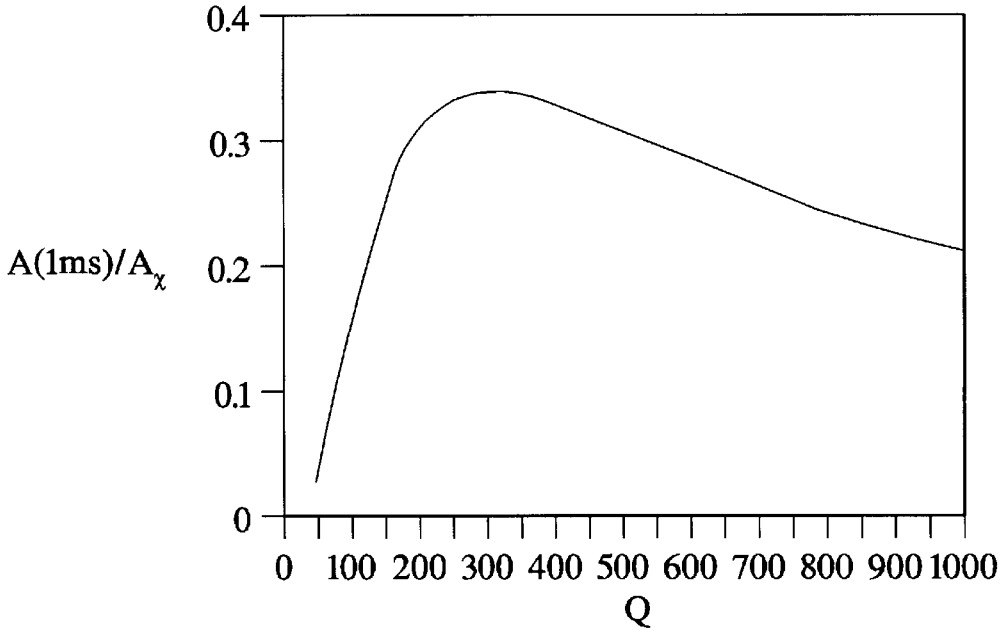
FIG. 10 shows the relationship between the ratio of signal amplitude in a burst mode and signal amplitude in a continuous mode, and the resonator quality Q, for illustrating why values of Q between 200 and 550 are particularly suited for a resonator.

FIG. 10 provides further information as to why a resonator Q between about 200 and 550 is particularly well-suited for the resonator 3.

As already described, the resonator Q determines the ring-down time of the resonator 3 according to $$A(t)=A(0)\exp(-t\,\pi f_r/Q).$$

During excitation, the resonator signal requires the same time constant to "ring-up", i.e., the signal A(0) immediately after excitation is given by $$A(0)=A_\infty(1-\exp(-t_{ON}\,\pi f_r/Q))$$

wherein $t_{ON}$ is the on-time of the burst transmitter and $A_\infty$ is the signal amplitude which would be obtained after an "infinite" time of excitation. In practice, "infinite" means a time scale much larger than $Q/\pi f_r$ (typically a few milliseconds). The amplitude $A_\infty$ is the resonator amplitude which is measured if the resonator is excited in a continuous mode, rather than in a burst mode as is used in a magnetomechanical surveillance system.

The combination of both of the above equations yields the value for the amplitude A1, i.e., the amplitude occurring 1 ms after excitation:

$$A(1\text{ ms})=A_{\infty}(1-\exp(-t_{ON}\pi f_r/Q))\exp(-1\text{ ms}\,\pi f_r/Q)$$

FIG. 10 plots this relation, i.e., A(1 ms)/$A_{\infty}$vs. Q(for t=1.7 ms) and shows that there is a maximum between Q values of 200 and 550. This means that such Q values ensure that the ring-down time (and thus the ring-up time as well) will be sufficiently short so that the resonator is sufficiently excited by ac-bursts while at the same time ensuring that the ring-down time will be long enough to provide sufficient signal for integration in the first detection window.

The magnetoacoustic properties react sensitively to the composition and to the annealing conditions. Material scatter, i.e., slight deviations from the target compositions, can be compensated by changing the annealing parameters. It is highly desirable to undertake this in an automated manner, i.e., to measure the resonator properties during annealing and to adjust the annealing parameters accordingly. It is not initially clear, however, how one can conclude or estimate what the magnetoacoustic properties of a short resonator will be from observation of the properties of a continuous ribbon.

Nonetheless, the above data shows that the anisotropy field of the resonator is closely correlated to the resonator properties. The anisotropy field of the resonator and the anisotropy field measured on a continuous ribbon only differ by the demagnetizing field. Thus, the anisotropy field $H_k$ of the continuous ribbon can be monitored, as well as its width and thickness, and from that the anisotropy field $H_k$ of the resonator can be calculated by adding the demagnetizing effect. This allows adjustment of the annealing parameters, for example, the annealing speed, in an automated manner, which results in highly reproducible properties of the annealed resonator material.

Although other modifications and changes may be suggested by those skilled in the art, it is the intention of the inventor to embody within the patent warranted hereon all changes and modifications as reasonably and properly come within the scope of his contribution to the art.

I claim as my invention:

1. A resonator for use in a marker in a magnetomechanical electronic article surveillance system, said resonator comprising:

an annealed amorphous magnetostrictive alloy having a composition $Fe_aCo_bNi_cSi_xB_y$, wherein a, b, c, x and y are at % and a+b+c+x+y=100, and a ranges from about 15 to about 30, b is at least about 12, c ranges from about 30 to about 50, and 79<a+b+c<85, said resonator having a linear B-H loop up to a minimum field strength of about 8 Oe, a quality Q between about 100 and 600, an anisotropy field $H_k$ of at least about 10 Oe and, when excited to resonate in the presence of a bias magnetic field $H_b$, producing a signal at a mechanical resonant frequency $f_r$ having an amplitude at approximately 1 ms after excitation which is no more than 15 dB below an amplitude of said signal immediately after excitation and an amplitude at approximately 7 ms after excitation which is at least 15 dB below said amplitude at 1 ms after excitation.

2. A resonator as claimed in claim 1 wherein said mechanical resonant frequency $f_r$ changes dependent on a field strength of said bias field $H_b$, wherein $|df_r/dH_b|$ is less than 700 Hz/Oe with $H_b$ between 6 and 7 Oe.

3. A resonator as claimed in claim 2 wherein $|df_r/dH_b|$ is between 550 and 650 Hz/Oe.

4. A resonator as claimed in claim 1 having a resonant frequency $f_r$ which changes by at least 1.2 kHz when said bias field $H_b$ is removed.

5. A resonator as claimed in claim 1 having a quality Q which is greater than 200.

6. A resonator as claimed in claim 1 having a quality Q which is less than 550.

7. A resonator as claimed in claim 1 having a width of approximately one-half inch, and wherein said annealed amorphous magnetostrictive alloy has a composition $Fe_{24}Co_{16}Ni_{42}Si_2B_{16}$.

8. A resonator as claimed in claim 1 having a width of approximately 6 mm, and wherein said annealed amorphous magnetostrictive alloy has a composition $Fe_{24}Co_{18}Ni_{40}Si_2B_{16}$.

9. A resonator as claimed in claim 1 wherein said resonator produces a signal having amplitude of at least 40 mV at approximately 1 ms after excitation of said resonator.

10. A resonator for use in a marker in a magnetomechanical electronic article surveillance system, said resonator comprising an annealed amorphous magnetostrictive alloy having a composition $Fe_aCo_bNi_cSi_xB_y$, wherein a, b, c, x and y are at % and a+b+c+x+y=100, said alloy being selected from the group of alloy sets consisting of a first alloy set wherein a is at least about 15 and b is at least about 32, a second alloy set wherein a ranges between about 15 and about 40, and a third alloy set wherein a ranges between 15 and about 42, b ranges between about 18 and about 32, and c is at least about 10, and said resonator having a linear B-H loop up to a minimum field strength of about 8 Oe, a quality Q between about 100 and 600, an anisotropy field $H_k$ of at least 10 Oe and, when excited to resonate in the presence of a bias magnetic field $H_b$, producing a signal at a mechanical resonant frequency $f_r$ having an amplitude at approximately 1 ms after excitation which is no more than 15 dB below an amplitude of said signal immediately after excitation and an amplitude at approximately 7 ms after excitation which is at least 15 dB below said amplitude at 1 ms after excitation.

11. A resonator as claimed in claim 10 wherein said mechanical resonant frequency $f_r$ changes dependent on a field strength of said bias field $H_b$, wherein $|df_r/dH_b|$ is less than 700 Hz/Oe with $H_b$ between 6 and 7 Oe.

12. A resonator as claimed in claim 11 wherein $|df_r/dH_b|$ is between 550 and 650 Hz/Oe.

13. A resonator as claimed in claim 10 having a resonant frequency $f_r$ which changes by at least 1.2 kHz when said bias field $H_b$ is removed.

14. A resonator as claimed in claim 10 having a quality Q which is greater than 200.

15. A resonator as claimed in claim 10 having a quality Q which is less than 550.

16. A resonator as claimed in claim 10 wherein said resonator produces a signal having amplitude of at least 40 mV at approximately 1 ms after excitation of said resonator.

17. A marker for use in a magnetomechanical electronic article surveillance system, said marker comprising:

a bias element which produces a bias magnetic field of up to 10 Oe;

a resonator disposed adjacent said bias element comprising an annealed amorphous magnetostrictive alloy having a composition $Fe_aCo_bNi_cSi_xB_y$, wherein a, b, c, x and y are at % and a+b+c+x+y=100, and a ranges from about 15 to about 30, b is at least about 12, c ranges from about 30 to about 50, and 79<a+b+c<85, said resonator having a linear B-H loop up to a minimum field strength of about 8 Oe, a quality Q between about 100 and 600, an anisotropy field $H_k$ of at least about 10 Oe and, when excited to resonate in the presence of a bias magnetic field $H_b$, producing a signal at a mechanical resonant frequency $f_r$ having an amplitude at approximately 1 ms after excitation which is no more than 15 dB below an amplitude of said signal immediately after excitation and an amplitude at approximately 7 ms after excitation which is at least 15 dB below said amplitude at 1 ms after excitation; and a housing encapsulating said bias element and said resonator.

18. A resonator as claimed in claim 17 wherein said mechanical resonant frequency $f_r$ changes dependent on a field strength of said bias field $H_b$, wherein $|df_r/dH_b|$ is less than 700 Hz/Oe with $H_b$ between 6 and 7 Oe.

19. A resonator as claimed in claim 18 wherein $|df_r/dH_b|$ is between 550 and 650 Hz/Oe.

20. A resonator as claimed in claim 17 having a resonant frequency $f_r$ which changes by at least 1.2 kHz when said bias field $H_b$ is removed.

21. A resonator as claimed in claim 17 having a quality Q which is greater than 200.

22. A resonator as claimed in claim 17 having a quality Q which is less than 550.

23. A resonator as claimed in claim 17 having a width of approximately one-half inch, and wherein said annealed amorphous magnetostrictive alloy has a composition $Fe_{24}Co_{16}Ni_{42}Si_2B_{16}$.

24. A resonator as claimed in claim 17 having a width of approximately 6 mm, and wherein said annealed amorphous magnetostrictive alloy has a composition $Fe_{24}Co_{18}Ni_{40}Si_2B_{16}$.

25. A resonator as claimed in claim 17 wherein said resonator produces a signal having amplitude of at least 40 mV at approximately 1 ms after excitation of said resonator.

26. A marker for use in a magnetomechanical electronic article surveillance system, said marker comprising:

a bias element which produces a bias magnetic field of up to 10 Oe;

a resonator comprising an annealed amorphous magnetostrictive alloy having a composition $Fe_aCo_bNi_cSi_xB_y$, wherein a, b, c, x and y are at % and a+b+c+x+y=100, said alloy being selected from the group of alloy sets consisting of a first alloy set wherein a is at least about 15 and b is at least about 32, a second alloy set wherein a ranges between about 15 and about 40, and a third alloy set wherein a ranges between 15 and about 42, b ranges between about 18 and about 32, and c is at least about 10, and said resonator having a linear B-H loop up to a minimum field strength of about 8 Oe, a quality Q between about 100 and 600, an anisotropy field $H_k$ of at least 10 Oe and, when excited to resonate in the presence of a bias magnetic field $H_b$, producing a signal at a mechanical resonant frequency $f_r$ having an amplitude at approximately 1 ms after excitation which is no more than 15 dB below an amplitude of said signal immediately after excitation and an amplitude at approximately 7 ms after excitation which is at least 15 dB below said amplitude at 1 ms after excitation; and a housing encapsulating said bias element and said resonator.

27. A resonator as claimed in claim 26 wherein said mechanical resonant frequency $f_r$ changes dependent on a field strength of said bias field $H_b$, wherein $|df_r/dH_b|$ is less than 700 Hz/Oe with $H_b$ between 6 and 7 Oe.

28. A resonator as claimed in claim 27 wherein $|df_r/dH_b|$ is between 550 and 650 Hz/Oe.

29. A resonator as claimed in claim 26 having a resonant frequency $f_r$ which changes by at least 1.2 kHz when said bias field $H_b$ is removed.

30. A resonator as claimed in claim 26 having a quality Q which is greater than 200.

31. A resonator as claimed in claim 26 having a quality Q which is less than 550.

32. A resonator as claimed in claim 26 wherein said resonator produces a signal having amplitude of at least 40 mV at approximately 1 ms after excitation of said resonator.

33. A magnetomechanical electronic article surveillance system comprising:

a marker comprising a bias element and a resonator, said resonator formed by an annealed amorphous magnetostrictive alloy having a composition $Fe_aCo_bNi_cSi_xB_y$, wherein a, b, c, x and y are at % and a+b+c+x+y=100, and a ranges from about 15 to about 30, b is at least about 12, c ranges from about 30 to about 50, and 79<a+b+c<85, said resonator having a linear B-H loop up to a minimum field strength of about 8 Oe, a quality Q between about 100 and 600, an anisotropy field $H_k$ of at least about 10 Oe and, when excited to resonate in the presence of a bias magnetic field $H_b$, producing a signal at a mechanical resonant frequency $f_r$ having an amplitude at approximately 1 ms after excitation which is no more than 15 dB below an amplitude of said signal immediately after excitation and an amplitude at approximately 7 ms after excitation which is at least 15 dB below said amplitude at 1 ms after excitation;

transmitter means for exciting said marker for causing said resonator to mechanically resonate and to emit said signal at a resonant frequency;

receiver means for receiving and integrating said signal from said resonator at said resonant frequency;

synchronization means connected to said transmitter means and to said receiver means for activating said receiver means for receiving and integrating said signal at said resonant frequency from said resonator in a first detection window beginning at approximately 0.4 ms after excitation of said resonator by said transmitter means and in a second detection window beginning at approximately 7 ms after excitation of said resonator by said transmitter means; and an alarm, said receiver means comprising means for triggering said alarm if said signal at said resonant frequency from said resonator integrated in said second detection window is substantially below said signal at said resonant frequency from said resonator integrated in said first detection window.

34. A resonator as claimed in claim 33 wherein said mechanical resonant frequency $f_r$ changes dependent on a field strength of said bias field $H_b$, wherein $|df_r/dH_b|$ is less than 700 Hz/Oe with $H_b$ between 6 and 7 Oe.

35. A resonator as claimed in claim 34 wherein $|df_r/dH_b|$ is between 550 and 650 Hz/Oe.

36. A resonator as claimed in claim 33 having a resonant frequency $f_r$ which changes by at least 1.2 kHz when said bias field $H_b$ is removed.

37. A resonator as claimed in claim 33 having a quality Q which is greater than 200.

38. A resonator as claimed in claim 33 having a quality Q which is less than 550.

39. A resonator as claimed in claim 33 having a width of approximately one-half inch, and wherein said annealed amorphous magnetostrictive alloy has a composition $Fe_{24}Co_{16}Ni_{42}Si_2B_{16}$.

40. A resonator as claimed in claim 33 having a width of approximately 6 mm, and wherein said annealed amorphous magnetostrictive alloy has a composition $Fe_{24}Co_{18}Ni_{40}Si_2B_{16}$.

41. A resonator as claimed in claim 33 wherein said resonator produces a signal having amplitude of at least 40 mV at approximately 1 ms after excitation of said resonator.

42. A magnetomechanical electronic article surveillance system comprising:

a marker comprising a bias element and a resonator, said resonator formed by an annealed amorphous magnetostrictive alloy having a composition $Fe_aCo_bNi_cSi_xB_y$, wherein a, b, c, x and y are at % and a+b+c+x+y=100, said alloy being selected from the group of alloy sets consisting of a first alloy set wherein a is at least about 15 and b is at least about 32, a second alloy set wherein a ranges between about 15 and about 40, and a third alloy set wherein a ranges between 15 and about 42, b ranges between about 18 and about 32, and c is at least about 10, and said resonator having a linear B-H loop up to a minimum field strength of about 8 Oe, a quality Q between about 100 and 600, an anisotropy field $H_k$ of at least 10 Oe and, when excited to resonate in the presence of a bias magnetic field $H_b$, producing a signal at a mechanical resonant frequency $f_r$ having an amplitude at approximately 1 ms after excitation which is no more than 15 dB below an amplitude of said signal immediately after excitation and an amplitude at approximately 7 ms after excitation which is at least 15 dB below said amplitude at 1 ms after excitation;

transmitter means for exciting said marker for causing said resonator to mechanically resonate and to emit said signal at a resonant frequency at said initial amplitude;

receiver means for receiving and integrating said signal from said resonator at said resonant frequency;

synchronization means connected to said transmitter means and to said receiver means for activating said receiver means for receiving and integrating said signal at said resonant frequency from said resonator in a first detection window beginning at approximately 0.4 ms after excitation of said resonator by said transmitter means and in a second detection window beginning at approximately 7 ms after excitation of said resonator by said transmitter means; and an alarm, said receiver means comprising means for triggering said alarm if said signal at said resonant frequency from said resonator integrated in said second detection window is substantially below said signal at said resonant frequency from said resonator integrated in said first detection window.

43. A resonator as claimed in claim 42 wherein said mechanical resonant frequency $f_r$ changes dependent on a field strength of said bias field $H_b$, wherein $|df_r/dH_b|$ is less than 700 Hz/Oe with $H_b$ between 6 and 7 Oe.

44. A resonator as claimed in claim 43 wherein $|df_r/dH_b|$ is between 550 and 650 Hz/Oe.

45. A resonator as claimed in claim 42 having a resonant frequency $f_r$ which changes by at least 1.2 kHz when said bias field $H_b$ is removed.

46. A resonator as claimed in claim 42 having a quality Q which is greater than 200.

47. A resonator as claimed in claim 42 having a quality Q which is less than 550.

48. A resonator as claimed in claim 42 wherein said resonator produces a signal having amplitude of at least 40 mV at approximately 1 ms after excitation of said resonator.

49. A method of making a resonator for use in a magnetomechanical electronic article surveillance system, comprising the steps of:

providing an amorphous magnetostrictive alloy having a composition $Fe_aCo_bNi_cSi_xB_y$, wherein a, b, c, x and y are at % and a+b+c+x+y=100, and a ranges from about 15 to about 30, b is at least about 12, c ranges from about 30 to about 50, and 79<a+b+c<85; and annealing said amorphous magnetostrictive alloy in a transverse magnetic field and at a temperature in a range between about 300° C. and about 400° C. for less than one minute for producing said annealed amorphous magnetostrictive alloy having a linear B-H loop up to a minimum field strength of about 8 Oe, a quality Q between about 100 and 600, an anisotropy field $H_k$ of at least about 10 Oe and, when excited to resonate in the presence of a bias magnetic field $H_b$, producing a signal at a mechanical resonant frequency $f_r$ having an amplitude at approximately 1 ms after excitation which is no more than 15 dB below an amplitude of said signal immediately after excitation and having an amplitude at approximately 7 ms after excitation which is at least 15 dB below said amplitude at 1 ms after excitation.

50. A method of making a resonator for use in a magnetomechanical electronic article surveillance system, comprising the steps of:

providing an amorphous magnetostrictive alloy having a composition $Fe_aCo_bNi_cSi_xB_y$, wherein a, b, c, x and y are at % and a+b+c+x+y=100, said alloy being selected from the group of alloy sets consisting of a first alloy set wherein a is at least about 15 and b is at least about 32, a second alloy set wherein a ranges between about 15 and about 40, and a third alloy set wherein a ranges between 15 and about 42, b ranges between about 18 and about 32, and c is at least about 10, and;

annealing said amorphous magnetostrictive alloy in a transverse magnetic field and at a temperature in a range between about 300° C. and about 400° C. for less than one minute for producing said annealed amorphous magnetostrictive alloy having a linear B-H loop up to a minimum field strength of about 8 Oe, a quality Q between about 100 and 600, an anisotropy field $H_k$ of at least about 10 Oe and, when excited to resonate in the presence of a bias magnetic field $H_b$, producing a signal at a mechanical resonant frequency $f_r$ having an amplitude at approximately 1 ms after excitation which is no more than 15 dB below an amplitude of said signal immediately after excitation and having an amplitude at approximately 7 ms after excitation which is at least 15 dB below said amplitude at 1 ms after excitation.

51. A method of making a marker for use in a magnetomechanical electronic article surveillance system, comprising the steps of:

providing an amorphous magnetostrictive alloy having a composition $Fe_aCo_bNi_cSi_xB_y$, wherein a, b, c, x and y are at % and a+b+c+x+y=100, and a ranges from about 15 to about 30, b is at least about 12, c ranges from about 30 to about 50, and 79<a+b+c<85;

annealing said amorphous magnetostrictive alloy in a transverse magnetic field and at a temperature in a range between about 300° C. and about 400° C. for less than one minute for producing said annealed amorphous magnetostrictive alloy having a linear B-H loop up to a minimum field strength of about 8 Oe, a quality Q between about 100 and 600, an anisotropy field $H_k$ of at least about 10 Oe and, when excited to resonate in the presence of a bias magnetic field $H_b$, producing a signal at a mechanical resonant frequency $f_r$ having an amplitude at approximately 1 ms after excitation which is no more than 15 dB below an amplitude of said signal immediately after excitation and having an amplitude at approximately 7 ms after excitation which is at least 15 dB below said amplitude at 1 ms after excitation;

placing said resonator adjacent a magnetized ferroelectric bias element; and encapsulating said resonator and said bias element in a housing.

52. A method of making a marker as claimed in claim 51 comprising the additional step of magnetizing said bias element for producing a bias field having a strength up to 10 Oe.

53. A method of making a marker for use in a magneto-mechanical electronic article surveillance system, comprising the steps of:

providing an amorphous magnetostrictive alloy having a composition $Fe_aCo_bNi_cSi_xB_y$, wherein a, b, c, x and y are at % and a+b+c+x+y=100, said alloy being selected from the group of alloy sets consisting of a first alloy set wherein a is at least about 15 and b is at least about 32, a second alloy set wherein a ranges between about 15 and about 40, and a third alloy set wherein a ranges between 15 and about 42, b ranges between about 18 and about 32, and c is at least about 10;

annealing said amorphous magnetostrictive alloy in a transverse magnetic field and at a temperature in a range between about 300° C. and about 400° C. for less than one minute for producing said annealed amorphous magnetostrictive alloy having a linear B-H loop up to a minimum field strength of about 8 Oe, a quality Q between about 100 and 600, an anisotropy field $H_k$ of at least about 10 Oe and, when excited to resonate in the presence of a bias magnetic field $H_b$, producing a signal at a mechanical resonant frequency $f_r$ having an amplitude at approximately 1 ms after excitation which is no more than 15 dB below an amplitude of said signal immediately after excitation and having an amplitude at approximately 7 ms after excitation which is at least 15 dB below said amplitude at 1 ms after excitation;

placing said resonator adjacent a magnetized ferroelectric bias element; and encapsulating said resonator and said bias element in a housing.

54. A method of making a marker as claimed in claim 53 comprising the additional step of magnetizing said bias element for producing a bias field having a strength up to 10 Oe.

* * * * *